US009611430B2

(12) United States Patent
Ploemen et al.

(10) Patent No.: US 9,611,430 B2
(45) Date of Patent: Apr. 4, 2017

(54) METHOD OF HANDLING A SOLVENT-CONTAINING SOLIDS STREAM IN A NON-AQUEOUS OIL SAND EXTRACTION PROCESS

(71) Applicants: Shell Canada Energy, Calgary (CA); Chevron Canada Limited, Calgary (CA); Marathon Oil Sands L.P., Calgary (CA)

(72) Inventors: Ingmar Hubertus Josephina Ploemen, Amsterdam (NL); Gerhardus Willem Colenbrander, Amsterdam (NL); Steven Paul Giles, Damon, TX (US)

(73) Assignee: SHELL OIL COMPANY, Houston, TX (US)

( * ) Notice: Subject to any disclaimer, the term of this patent is extended or adjusted under 35 U.S.C. 154(b) by 510 days.

(21) Appl. No.: 14/166,355

(22) Filed: Jan. 28, 2014

(65) Prior Publication Data

US 2014/0209511 A1 Jul. 31, 2014

Related U.S. Application Data

(60) Provisional application No. 61/758,350, filed on Jan. 30, 2013.

(51) Int. Cl.
*C10G 1/04* (2006.01)

(52) U.S. Cl.
CPC ..... *C10G 1/04* (2013.01)

(58) Field of Classification Search
CPC ..... C10G 1/04
See application file for complete search history.

(56) References Cited

U.S. PATENT DOCUMENTS 5,992,050 A * 11/1999 Kemper ..... A23L 1/0151 34/237
6,279,250 B1 * 8/2001 Anderson ..... F26B 3/00 34/164
2011/0127197 A1 * 6/2011 Blackbourn ..... C10G 1/04 208/390

* cited by examiner

*Primary Examiner* — Randy Boyer
*Assistant Examiner* — Juan Valencia

(57) ABSTRACT

The present invention provides a method of handling a solvent-containing solids stream in a non-aqueous oil sand extraction process, the method including the steps of: (a) providing a solvent-containing solids stream at a first pressure; (b) depositing the solvent-containing solids stream provided in step (a) as a bed in a vessel; (c) discharging the solvent-containing solids stream from the vessel at a second pressure via an outlet, thereby obtaining a depressurized solvent-containing solids stream; wherein the solvent-containing solids stream in the vessel in step (b) is at a temperature above the boiling point of the solvent in the depressurized solvent-containing solids stream at the second pressure in step (c).

23 Claims, 1 Drawing Sheet

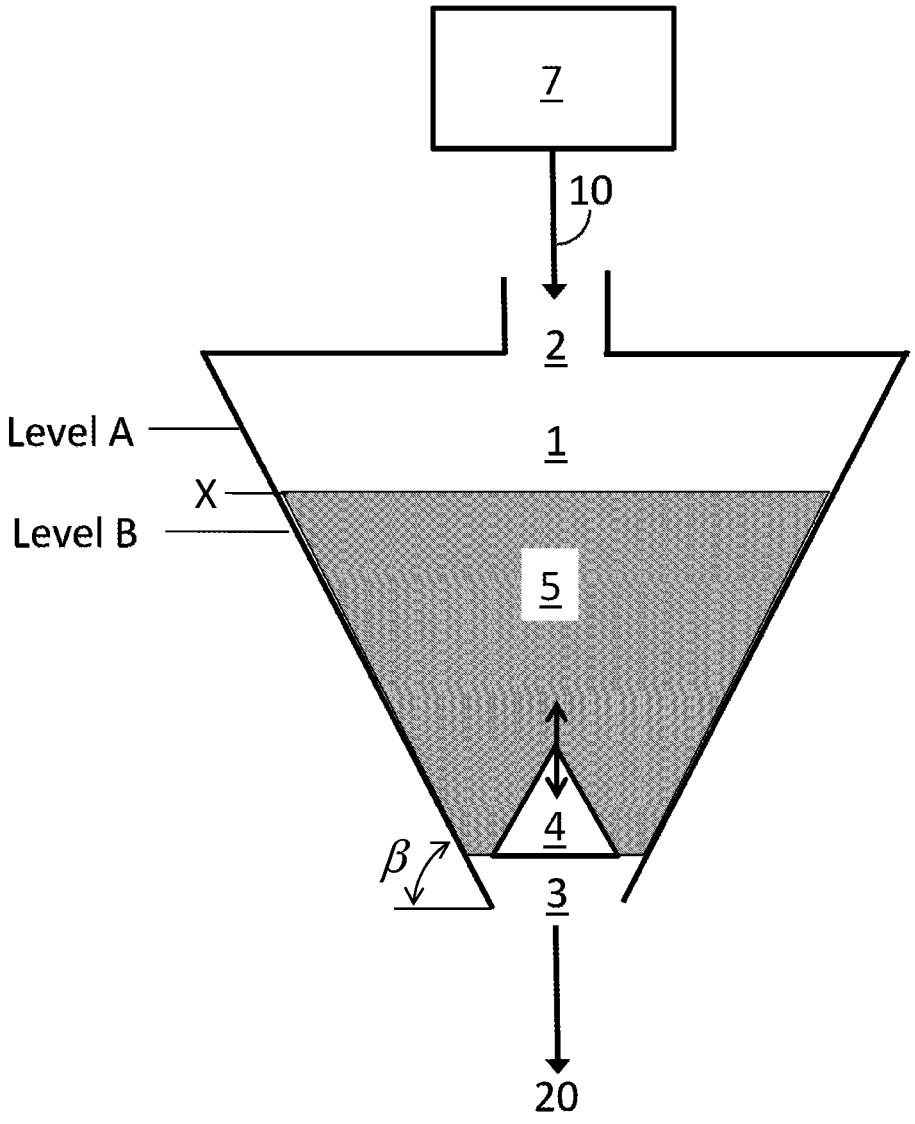
7
10
2
1
Level A
X
Level B
5
4
β
3
20

METHOD OF HANDLING A SOLVENT-CONTAINING SOLIDS STREAM IN A NON-AQUEOUS OIL SAND EXTRACTION PROCESS

RELATED APPLICATIONS

This application claims the benefit of U.S. Provisional Application No. 61/758,350 filed Jan. 30, 2013, which is incorporated herein by reference.

BACKGROUND

The present invention relates to a method of handling, in particular depressurizing, a solvent-containing solids stream in a non-aqueous oil sand extraction process (i.e. using a non-aqueous solvent).

Various methods have been proposed in the past for the recovery of bitumen (sometimes referred to as "tar" or "bituminous material") from oil sands as found in various locations throughout the world and in particular in Canada such as in the Athabasca district in Alberta and in the United States such as in the Utah oil sands. Typically, oil sand (also known as "bituminous sand" or "tar sand") comprises a mixture of bitumen (in this context also known as "crude bitumen", a semi-solid form of crude oil; also known as "extremely heavy crude oil"), sand, clay minerals and water. Usually, oil sand contains about 5 to 25 wt. % bitumen (as meant according to the present invention), about 1 to 13 wt. % water, the remainder being sand and clay particles.

As an example, it has been proposed and practiced at commercial scale to recover the bitumen content from the oil sand in an extraction process by mixing the oil sand with water and separating the sand from the aqueous phase of the slurry formed.

Other methods have proposed non-aqueous extraction processes (i.e. using a non-aqueous solvent) to reduce the need for large quantities of process water.

A problem of known methods of non-aqueous extraction of bitumen from oil sand is the handling of solvent-containing solids streams and in particular the removal of the non-aqueous solvent from the solids. Significant amounts of heat would be needed to evaporate the non-aqueous solvent. Also, if a pressure-filtration step (i.e. applying pressure above the filter bed during filtration) would be used during filtration this may create issues with respect to depressurizing the pressurized stream (viz. the processed filter cake that has been removed from the filter), which would typically take place in a rotary valve or lock hopper, which devices are expensive and sensitive to wear.

It is an object of the present invention to improve the handling, in particular depressurizing, of solvent-containing solids streams.

It is a further object of the present invention to avoid or at least minimize the issue of handling, in particular depressurizing, a pressurized solvent-containing solids stream, in particular obtained after a filtration step in a non-aqueous oil sand extraction process.

One or more of the above or other objects may be achieved according to the present invention by providing a method of handling a solvent-containing solids stream in a non-aqueous oil sand extraction process, the method comprising at least the steps of:

(a) providing a solvent-containing solids stream at a first pressure;

(b) depositing the solvent-containing solids stream provided in step (a) as a bed in a vessel;

(c) discharging the solvent-containing solids stream from the vessel at a second pressure via an outlet, thereby obtaining a depressurized solvent-containing solids stream;

wherein the solvent-containing solids stream in the vessel in step (b) is at a temperature above the boiling point of the solvent in the depressurized solvent-containing solids stream at the second pressure in step (c).

It has now been found that the method according to the present invention provides a surprisingly simple and elegant manner to handle solvent-containing solids streams in an oil sand extraction process using a non-aqueous solvent. The method according to the present invention is, although not limited thereto, of particular use in handling, in particular depressurizing, a pressurized solvent-containing solids stream (such as the heated filter cake obtained in a pressure-filtration step) in a non-aqueous oil sand extraction process.

An advantage of the present invention is that very simple outlet devices such as cone valves can be used. There is no need to use more complicated outlet devices such as rotary star valves or lock hoppers. When using rotary star valves, pressure barriers are established by valve compartments separated by the valve vanes of the rotary star valve (according to the present invention, the bed of solvent-containing solids functions as a pressure barrier). Such rotary star valves are expensive, sensitive to wear and maintenance-intensive. Also, replacement of such rotary star valves may take a long time.

The person skilled in the art is familiar with a non-aqueous oil sand extraction process; hence this will not be described here in further detail. Typically, a non-aqueous oil sand extraction process comprises at least the steps of:

reducing the oil sand ore in size, e.g. by crushing, breaking and/or grinding, to below a desired size upper limit (such as for example 20 inch);

contacting the oil sand with a non-aqueous solvent, thereby obtaining a solvent-diluted oil sand slurry;

filtering the solvent-diluted oil sand slurry (whilst possibly applying pressure-filtration), thereby obtaining a solids-depleted stream and a solids-enriched stream ('filter cake'); and removing solvent from the solids-depleted stream obtained thereby obtaining a bitumen-enriched stream that can be further processed to obtain the bitumen. The bitumen may subsequently be further processed in e.g. a refinery.

The method according to the present invention is of particular use for depressurizing a solvent-containing solids stream (i.e. the 'filter cake' as mentioned above) after a pressure-filtration step.

In step (a) a solvent-containing solids stream is provided at a first pressure. As mentioned above, the solvent-containing solids stream is obtained in a non-aqueous oil sand extraction process (i.e. using a non-aqueous solvent) and is preferably obtained in a pressure-filtration step in the non-aqueous oil sand extraction process.

The solvent as used in the method of the present invention may be selected from a wide variety of non-aqueous solvents (although a small amount of water may be present), aromatic hydrocarbon solvents and saturated or unsaturated aliphatic (i.e. non-aromatic) hydrocarbon solvents; aliphatic hydrocarbon solvents may include linear, branched or cyclic alkanes and alkenes and mixtures thereof. Preferably, the solvent comprises an aliphatic hydrocarbon having from 3 to 9 carbon atoms per molecule, more preferably from 4 to 7 carbons per molecule, or a combination thereof. Especially suitable solvents are saturated aliphatic hydrocarbons such as propane, butane, pentane, hexane, heptane, octane and nonane (including isomers thereof), in particular butane, pentane, hexane and heptanes, preferably pentane. It is preferred that the solvent in step (a) comprises at least 50 wt. %, preferably at least 90 wt. % of the aliphatic hydrocarbon having from 3 to 9 carbon atoms per molecule, more preferably at least 95 wt. %. Also, it is preferred that in step (a) substantially no aromatic solvent (such as toluene or benzene) is present, i.e. less than 5 wt. %, preferably less than 1 wt. %. Further it is preferred that a single solvent is used as this avoids the need for a distillation unit or the like to separate solvents. Also, it is preferred that the solvent has a boiling point lower than that of the bitumen to facilitate easy separation and recovery.

As mentioned above, the solvent-containing solids stream provided in step (a) is preferably a filter cake obtained in the oil sand extraction process.

Preferably, the solvent-containing solids stream provided in step (a) contains from 1.0 wt. % to 20 wt. % solvent. Preferably, and in particular when the solvent is pentane, the solvent-containing solids stream provided in step (a) contains from 2.0 wt. % to 15 wt. % solvent, preferably at least 3.0 wt. %, more preferably at least 4.0 wt. % and preferably at most 12 wt. %, more preferably at most 10 wt. %, based on the weight of the solids in the solvent-containing solids stream.

Further it is preferred, that the solvent-containing solids stream provided in step (a) contains from 2.0 wt. % to 10 wt. % water, preferably at least 3.0 wt. % and preferably at most 7.0 wt. %, based on the weight of the solids in the solvent-containing solids stream.

Also it is preferred, that the solvent-containing solids stream provided in step (a) contains from 0.1 wt. % to 10 wt. % bitumen, preferably at least 0.2 wt. %, more preferably at least 0.3 wt. % and preferably at most 2.0 wt. %, more preferably at most 1.5 wt. %, based on the weight of the solids in the solvent-containing solids stream.

Typically, the solvent-containing solids stream provided in step (a) contains from 79.0 wt. % to 97.0 wt. % solids, preferably at least 85.0 wt. %, more preferably at least 88.0 wt. %, and preferably at most 96.0 wt. %, more preferably at most 94.0 wt. %.

Typically, the first pressure in step (a) is at an elevated level and equal to or slightly above the vapour pressure of the solvent-containing solids stream. Preferably and in particular when the solvent is pentane, the solvent-containing solids stream provided in step (a) has a (first) pressure from 1.5 bara to 6.0 bara, preferably at least 2.0 bara and preferably at most 5.0 bara.

Also, the solvent-containing solids stream provided in step (a) is typically at an elevated temperature. Preferably, and in particular when the solvent is pentane, the solvent-containing solids stream provided in step (a) has a temperature from 50° C. to 100° C., preferably at least 60° C. and preferably at most 90° C.

In step (b), the solvent-containing solids stream provided in step (a) is deposited as a bed in a vessel. The person skilled in the art will readily understand that the vessel is not limited in any way. Typically, the vessel is selected such that the discharge (in step (c)) of the solvent-containing solids stream through a bottom outlet is facilitated. Preferably the bed of solvent-containing solids is not supported (by a grid, mesh or the like) as this would hamper the subsequent discharge of the solvent-containing solids.

In step (c), the solvent-containing solids stream is discharged from the vessel at a second pressure via an outlet, thereby obtaining a depressurized solvent-containing solids stream. The second pressure (in step (c)) is at a lower pressure than the first pressure (in step (a)).

Preferably, the depressurized solvent-containing solids stream obtained in step (c) has a pressure from 0.8 bara to 1.5 bara, preferably from 0.9 bara to 1.2 bara.

Further it is preferred that, in particular when the solvent is pentane, the depressurized solvent-containing solids stream obtained in step (c) has a temperature from 40° C. to 60° C., preferably at least 45° C. and preferably at most 55° C.

The person skilled in the art will readily understand that the outlet of the vessel may have various sizes and shapes and may be at various locations in the vessel, as long as a bed of solids is present between the inlet and the outlet of the vessel. Preferably, the outlet as used in step (c) is a bottom outlet. Preferably, the bottom outlet comprises a cone valve. Suitable cone valves can be obtained from e.g. ISL Cone Valve Technology (Moreton in Marsh, UK).

Further it is preferred that the upper level of the bed of solvent-containing solids in the vessel is maintained between a preselected upper limit and lower limit. This, to ensure that a suitable pressure barrier is created between the solvent-containing solids stream at the first pressure and the depressurized solvent-containing solids stream at the second pressure. Also, the bed avoids or at least minimizes a vapour slip stream through the bed. This maintaining of the level of the bed may be done by for example using a cone valve discharge opening and properly adjusting the cross-sectional area of the cone valve discharge opening.

The person skilled in the art will readily understand that the depressurized solvent-containing solids stream obtained in step (c) may be further processed to separate the solvent vapour from the solids, e.g. using a vessel, cyclone, scrubber or the like.

BRIEF DESCRIPTION OF THE DRAWINGS

Hereinafter the invention will be further illustrated by the following non-limiting drawing. Herein shows:

FIG. 1 schematically a non-limiting embodiment of a vessel suitable for use in a method in accordance with the present invention.

DETAILED DESCRIPTION OF THE DRAWINGS

For the purpose of this description, a single reference number will be assigned to a line as well as a stream carried in that line.

FIG. 1 schematically shows a vessel suitable for use in a method in accordance with the present invention for handling a solvent-containing solids stream in a non-aqueous oil sand extraction process. The vessel is generally referred to with reference numeral 1. The vessel 1 (with cone angle β) has an inlet 2, a bottom outlet 3 (comprising a cone valve 4) and a bed 5 of solvent-containing solids. Further, FIG. 1 shows the presence of a filter 7, upstream of the vessel 1.

During use of the vessel 1 of FIG. 1, a solvent-containing solids stream 10 is provided at a first pressure. In the embodiment of FIG. 1 the solvent-containing solids stream 10 is a filter cake obtained from the filter 7. The solvent-containing solids stream 10 is deposited as a bed 5 in the vessel 1.

Subsequently, the solvent-containing solids stream from the vessel 1 is discharged at a second pressure (which is lower than the first pressure) via the cone valve 4 of the bottom outlet 3, thereby obtaining a depressurized solvent-containing solids stream 20. The upper level X of the bed 5 in the vessel 1 is maintained between a preselected upper limit A and lower limit B to ensure that a suitable pressure barrier is created between the solvent-containing solids stream 10 at the first pressure and the discharged depressurized solvent-containing solids stream 20 at the second pressure. When discharged, the depressurized solvent-containing solids stream 20 is at a temperature at or above the boiling point of the solvent at the second pressure. Because of the pressure decrease during the discharge, part or all of the solvent present in the solvent-containing solids stream 10 vaporizes. The depressurized solvent-containing solids-stream can be removed via the cone valve 4.

Table 1 below shows a non-limiting example in which a filter cake coming from a filter unit is depressurized, using pentane as the non-aqueous solvent. Table 1 provides information on the vessel and conditions and compositions of the various streams, whilst using the scheme of FIG. 1.

TABLE 1

| | |
|---|---|
| Conical vessel diameter | 11 m |
| Cone angle β | 68 degrees |
| Solids bed height | 9.65 m |
| Cross-sectional area of annular vessel discharge outlet | 0.66 $m^2$ |
| Outlet slit width | 0.1 m |
| (Pentane) solvent content of filter cake | 60 g per kg of solids (6.0 wt. %) |
| Water content of filter cake | 5.0 wt. % |
| Bitumen content of filter cake | 1.0 wt. % |
| Bed permeability | 10,000 mDarcy |
| Temperature at vessel inlet | 72° C. |
| Temperature at vessel outlet | 50° C. |
| Pressure at vessel inlet (first pressure) | 3.0 bara |
| Pressure at vessel outlet | 1.0 bara |
| Sand flow rate | 1082 metric ton/hour |
| Pentane slip through bed | 7 kg/hour |

The pressurized filter cake is suitably depressurized using the method according to the present invention. Also, the pentane slip from the high pressure to the low pressure side of the bed is very low.

The person skilled in the art will readily understand that many modifications may be made without departing from the scope of the invention. Further, the person skilled in the art will readily understand that, while the present invention in some instances may have been illustrated making reference to a specific combination of features and measures, many of those features and measures are functionally independent from other features and measures given in the respective embodiment(s) such that they can be equally or similarly applied independently in other embodiments.

We claim:

1. A method of handling a solvent-containing solids stream in a non-aqueous oil sand extraction process, the method comprising at least the steps of:

(a) providing a solvent-containing solids stream at a first pressure;

(b) depositing the solvent-containing solids stream provided in step (a) as a bed in a vessel;

(c) discharging the solvent-containing solids stream from the vessel at a second pressure via an outlet comprising a cone valve, thereby obtaining a depressurized solvent-containing solids stream and vaporizing part of the solvent present in the bed; wherein the solvent-containing solids stream in the vessel in step (b) is at a temperature above the boiling point of the solvent in the depressurized solvent-containing solids stream at the second pressure in step (c).

2. The method according to claim 1, wherein the solvent comprises an aliphatic hydrocarbon.

3. The method according to claim 2, wherein the solvent comprises an aliphatic hydrocarbon having from 3 to 9 carbon atoms per molecule, or a combination thereof.

4. The method according to claim 3, wherein the solvent comprises an aliphatic hydrocarbon having from 4 to 7 carbons per molecule, or a combination thereof.

5. The method according to claim 1, wherein the solvent-containing solids stream provided in step (a) is a filter cake obtained in the oil sand extraction process.

6. The method according to claim 1, wherein the solvent-containing solids stream provided in step (a) contains from 2.0 wt. % to 15 wt. % solvent based on the weight of the solids in the solvent-containing solids stream.

7. The method according to claim 6, wherein the solvent-containing solids stream provided in step (a) contains from 3.0 wt. % to 12 wt. % solvent based on the weight of the solids in the solvent-containing solids stream.

8. The method according to claim 7, wherein the solvent-containing solids stream provided in step (a) contains from 4.0 wt. % to 12 wt. % solvent based on the weight of the solids in the solvent-containing solids stream.

9. The method according to claim 8, wherein the solvent-containing solids stream provided in step (a) contains from at 4.0 wt. % to 10 wt. % solvent based on the weight of the solids in the solvent-containing solids stream.

10. The method according to claim 1, wherein the solvent-containing solids stream provided in step (a) contains from 2.0 wt. % to 10 wt. % water, based on the weight of the solids in the solvent-containing solids stream.

11. The method according to claim 10, wherein the solvent-containing solids stream provided in step (a) contains from 3.0 wt. % to 7.0 wt. % water, based on the weight of the solids in the solvent-containing solids stream.

12. The method according to claim 1, wherein the solvent-containing solids stream provided in step (a) contains from 0.1 wt. % to 10 wt. % bitumen, based on the weight of the solids in the solvent-containing solids stream.

13. The method according to claim 12, wherein the solvent-containing solids stream provided in step (a) contains from 0.2 wt. % to 2.0 wt. % bitumen, based on the weight of the solids in the solvent-containing solids stream.

14. The method according to claim 1, wherein the solvent-containing solids stream provided in step (a) contains from 0.3 wt. % and 1.5 wt. % bitumen, based on the weight of the solids in the solvent-containing solids stream.

15. The method according to claim 1, wherein the solvent-containing solids stream provided in step (a) has a pressure from 1.5 bara to 6.0 bara.

16. The method according to claim 1, wherein the solvent-containing solids stream provided in step (a) has a pressure from 2.0 bara to 5.0 bara.

17. The method according to claim 1, wherein the solvent-containing solids stream provided in step (a) has a temperature from 50° C. to 100° C.

18. The method according to claim 1, wherein the depressurized solvent-containing solids stream obtained in step (c) has a pressure from 0.8 bara to 1.5 bara.

19. The method according to claim 1, wherein the depressurized solvent-containing solids stream obtained in step (c) has a pressure from 0.9 bara to 1.2 bara.

20. The method according to claim 1, wherein the depressurized solvent-containing solids stream obtained in step (c) has a temperature from 40° C. to 60° C.

21. The method according to claim 1, wherein the depressurized solvent-containing solids stream obtained in step (c) has a temperature from 45° C. to 55° C.

22. The method according to claim 1, wherein the outlet as used in step (c) is a bottom outlet.

23. The method according to claim 1, wherein an upper level of the bed in the vessel is maintained between a preselected upper limit and lower limit.

* * * * *